US006749406B2

(12) United States Patent
Keilman

(10) Patent No.: US 6,749,406 B2
(45) Date of Patent: Jun. 15, 2004

(54) ULTRASONIC PUMP WITH NON-PLANAR TRANSDUCER FOR GENERATING FOCUSED LONGITUDINAL WAVES AND PUMPING METHODS

(76) Inventor: George Keilman, 20018 163$^{rd}$ Ave. NE., Woodinville, WA (US) 98072

( * ) Notice: Subject to any disclaimer, the term of this patent is extended or adjusted under 35 U.S.C. 154(b) by 0 days.

(21) Appl. No.: 10/118,767

(22) Filed: Apr. 9, 2002

(65) Prior Publication Data

US 2003/0059317 A1 Mar. 27, 2003

Related U.S. Application Data

(60) Provisional application No. 60/282,616, filed on Apr. 9, 2001, provisional application No. 60/282,617, filed on Apr. 9, 2001, provisional application No. 60/282,618, filed on Apr. 9, 2001, provisional application No. 60/282,619, filed on Apr. 9, 2001, and provisional application No. 60/282,620, filed on Apr. 9, 2001.

(51) Int. Cl.$^{7}$ ..... F04B 17/00

(52) U.S. Cl. ..... 417/322; 40/53; 40/413.1

(58) Field of Search ..... 417/53, 63, 322, 417/412, 413.1, 52, 54, 55, 62, 323, 411, 413.2, 413.3, 415, 419, 423.19; 604/140, 151

(56) References Cited

U.S. PATENT DOCUMENTS 5,982,801 A * 11/1999 Deak ..... 372/69
6,010,316 A * 1/2000 Haller et al. ..... 417/322
6,210,128 B1 * 4/2001 Rife et al. ..... 417/322

FOREIGN PATENT DOCUMENTS

JP 355005464 A * 1/1980
JP 406101700 A * 4/1994

* cited by examiner

*Primary Examiner*—Justine R. Yu
*Assistant Examiner*—John F. Belena
(74) *Attorney, Agent, or Firm*—Harness, Dickey & Pierce, P.L.C.

(57) ABSTRACT

An ultrasonic pump in which a medium is pumped by the interaction between longitudinal acoustic waves and the medium in a flow-chamber. The pump comprises a non-planar, transducer and an associated chamber for providing a controllable, focused, acoustic traveling wave therein. The chamber includes a tapered passage corresponding to the focused beam pattern of the focused acoustic traveling wave through which the liquid medium flows and/or cavitation is induced and/or controlled. The pump therefore utilizes a focused, non-planar, acoustical transducer responsive to frequency input for directing longitudinal acoustic waves into the flow-chamber which induces a pressure gradient. The medium in the flow-chamber flows in the direction of travel of the acoustic wave in the chamber as a result of acoustic streaming. The exit orifice of the nozzle in communication with the chamber is strategically located at about the focal zone of the focused, traveling wave. Thus, the pump provides ultrasonic control of a medium to provide selective motion and cavitation.

38 Claims, 9 Drawing Sheets

ULTRASONIC PUMP WITH NON-PLANAR TRANSDUCER FOR GENERATING FOCUSED LONGITUDINAL WAVES AND PUMPING METHODS

RELATED APPLICATIONS

This utility application for U.S. patent claims priority under 35U.S.C. §119(e) to earlier filed U.S. Provisional Applications, Serial No. 60/282,616, Serial No. 60/282,617, Serial No. 60/282,618, Serial No. 60/282,619 and Serial No. 60/282,620, each of which was filed on Apr. 9, 2001 and is incorporated by reference in its entirety for all purposes into this utility application for U.S. patent.

U.S. Patent Application

This application is filed as a utility application under U.S.C., Title 35, §111 (a).

FIELD OF THE INVENTION

This invention relates to an ultrasonic pump for pumping a non-solid medium or fluid, such as a liquid, a liquid metal, a gas or an aerosol, via absorption by the medium of non-planar focused ultrasonic longitudinal waves directly generated by a single- or broad-bandwidth, non-planar transducer.

BACKGROUND OF THE INVENTION

There are many types of electromechanical pumps utilized today to pump fluids, such as gear pumps, centrifugal pumps, roller pumps, piston and peristaltic pumps, all of which require moving parts for proper operation. Typically, these moving parts are designed in relation to the amount of fluid to be pumped per unit time and the overall volume of the physical pump design.

Piston pumps are generally defined as having rotating pistons of varying stroke lengths to pump fluid media through check valves. Because piston pumps are capable of generating great pressure, they are suitable for high pressure applications. Nevertheless, piston pumps require many moving parts such as a piston, piston rod, crankshaft, and associated valve assemblies.

Peristaltic pumps are generally defined as having rollers driven by a motor which push a fluid medium along the internal diameter of tubing as the rollers are rotated by the motor. Peristaltic pumps are considered safe, mainly because the pumped the fluid medium never contacts an environment different than the surfaces of the internal tubing. They are used widely in the medical and pharmaceutical sector where the prevention of contamination is a factor. One major disadvantage associated with peristaltic pumps lies in the possible crushing forces that result upon the fluid medium being pumped, in those instances where the tubing constricts completely. Moreover, the moving parts of the peristaltic pumps usually undergo fatigue, as a result of their continuous operation and this can result in particles being shed from the tubing.

There are also for consideration the operation of sonic and ultrasonic pumps that feature as an embodiment the use of acoustic waves for their principle of operation, for example,. Mandroian U.S. Pat. No. 3,743,446, Lucas U.S. Pat. No. 5,020,977, and Lucas U.S. Pat. No. 5,263,341, Haller et al., U.S. Pat. No. 6,010,316, Culp, U.S. Pat. No. 5,267,836, Oeftering, U.S. Pat. No. 6,029,518, Oeftering, U.S. Pat. No. 5,520,715, Oeftering, U.S. Pat. No. 6,003,388, Murphy, U.S. Pat. No. 4,753,579, Murphy, U.S. Pat. No. 4,684,328, Kamen et al., U.S. Pat. No. 5,349,852, Meise, U.S. Pat. No. 5,295,791, White, et al., U.S. Pat. No. 5,212,988, Keilman, U.S. Pat. No. 4,475,376, Haller and Khuri-Yakub, U.S. Pat. No. 6,010,316, Masahiro, JP 550005454A2, Kazuo, et al., JP 62191679A2, and Kawai, et al., JP 5079459A2.

Referring to U.S. Pat. No. 3,743,446, invented by Mandroian, it uses a source of sound from a fluctuating diaphragm or piezoelectric transducer that oscillates at a preselected frequency. The frequency of oscillation of the diaphragm piezoelectric transducer and the length of the pump chamber are configured together so that this arrangement forms a resonant cavity (chamber) where acoustic standing waves are established in the fluid which allows for a pressure node or antinode at the wall opposite the diaphragm piezoelectric transducer.

Referring now to U.S. Pat. Nos. 5,020,947 and 5,263,341, each invented by Lucas, the theory of operation and so with the basic embodiment of both patents acknowledges the objective of using standing waves of acoustic pressure for creating nodes which are periodic points of minimum pressure and antinodes which are periodic points of maximum pressure. These nodes and antinodes are required to be precisely located at the entrance and exit fluid ports and, thus, the standing wave phenomenon as relied upon in Lucas requires a resonant state for proper operation. Moreover, the compressors in the Lucas patents require that a very narrow resonant operational frequency range be utilized by way of special electronic control circuitry, which includes a microprocessor controlled phase locked loops to insure frequency stability, thus adding to the complexity of the design. Such control circuitry is necessary for such a complex compressor system used for refrigeration.

Thus, the essence of the compressors described in the Lucas' patents require the creation of a standing wave within a resonant chamber or cavity and attempts to maintain the standing wave with its fixed periodic nodes and antinodes of pressure.

Turning now to U.S. Pat. No. 5,349,852, invented by Kamen et al., it describes a method of controlling a pump by using an acoustically resonant chamber driven by a loudspeaker to measure the volume of fluid in the chamber. There is no acoustic aspect to the pumping action and, in fact, this method of pump control could be applied to virtually any type of pump.

U.S. Pat. No. 5,378,120, invented by Taig, concerns a piezoelectric pump, not an ultrasonic pump. A stack of piezoceramic material is driven with a voltage to produce a volume displacement of fluid in a chamber. The piezoelectric stack is driven at a low (probably sonic) frequency to resonate a diaphragm which also acts as a check valve for the pump. This pump does not produce or rely upon ultrasonic waves or momentum transfer from the waves to the fluid.

U.S. Pat. No. 5,295,791, invented by Meise, concerns a low-frequency device wherein an acoustic resonance is established in a gas within a tube. Pressure differences at nodes and anti-nodes are used to advantage for refrigeration because there is a temperature differential between the two. This type of device has much in common with an organ pipe or a musical instrument, where a resonant tube is used to produce sound, except here they are using the structure in reverse: sound is applied, and a temperature difference results.

U.S. Pat. No. 5,212,988, invented by White, et al., describes the basic principles of a SAW sensor. These devices operate typically at several hundred MHz. A Lamb wave (a type of surface wave) is generated on the surface of a plate. The plate is coated with a polymer that is sensitive to the desired substance; usually, it absorbs the material, and changes its mass. The Lamb wave velocity and attenuation are affected by the changing properties of the polymer "sensor" film, and so you measure the Lamb wave and infer what is being sensed by the film.

Japanese Patent Document No. 62191679A2, authored by Kazuo, et al., concerns a "resilient" plate, such as possibly rubber, attached to a tapered end of a horn-type transducer. These devices typically operate in the range of 10 to 30 kHz. Basically, this is a diaphragm-type pump, where the diaphragm is being driven by an ultrasonic horn transducer. Nevertheless, the pumping action is mechanical and is unrelated to any acoustic waves that it might also produce in the fluid.

Japanese Patent Document No. 5079459A2, authored by Kawai, et al., appears to describe an ultrasonic motor which is being used to drive a micropump. The motor seems to function by producing a vibration in a plate which travels in a circle and causes a rotating element to turn in one direction, and are quite common in many items such as camera lenses. This is a low-frequency (audio range) device.

U.S. Pat. No. 4,475,376, invented by Keilman, describes an ultrasound transducer testing device. It has a focused ultrasonic transducer at the large end of a fluid-filled conical chamber, which tapers down to a small opening at the other end.

U.S. Pat. No. 6,010,316, invented by Haller and Khuri-Yakub, concerns an ultrasonic micro pump which describes a planar transducer and requires a simple high-velocity plano-concave lens to focus the ultrasonic waves generated by a transducer. The lens described by Haller et al is limited because of its material properties (silicon nitride, density 3.27 g/cm$^3$, longitudinal sound velocity of about 11,000 m/sec and an impedance of 36.0 Mrayls). Apparently, this material was used because it is easily achieved on a silicon wafer. It is, however, an extremely poor choice acoustically because of the high degree of acoustic mismatch between silicon nitride and water (36 vs. 1.485 MRayls). It is believed that this will result in approximately 15% power transmission from the lens into the water at normal incidence, and even less than about 15% transmitted at oblique incidence (i.e., near the periphery of the lens). The ~85% of the power that reflects back into the lens will be partially converted into a shear wave and part will remain as a longitudinal wave traveling within the silicon nitride. These waves will reverberate within the silicon nitride. While perhaps a small fraction of the energy will ultimately reflect in such a manner as to couple into the water, but even if it does so, it will likely be out of phase with the directly-coupled water signal, and thus it will distort the beam focus. This lens will likely only effectively couple 15 percent of the power into the water.

Alternatively, Hailer et al. describes an interdigital transducer which generates surface waves that are then mode converted to pump medium or fluid. In addition, this Hailer et al patent refers to a "pumping channel" that is 6.25 $\mu$m$^2$ to 2.25 mm$^2$ in cross-sectional area (Note: 1 $\mu$m =1 micron= 0.001 mm) and it states that the ultrasonic frequency is 1 GHz to 1 MHz. It appears from column 3, lines 30–33, that the channel is preferably sized for single-mode propagation, which means that the channel is basically one acoustic wavelength wide and one wavelength high and square in cross-section. This patent further states that at 1 MHz, it should be 1.5 mm wide (which corresponds to the 2.25 mm$^2$ cross-sectional area in claim 1), at 600 MHz it should be 2.5 $\mu$m wide (corresponding to 6.25 $\mu$m$^2$ in claim 1), and at 1 GHz it should be 1.5 $\mu$m wide (or 2.25 $\mu$m$^2$).

SUMMARY OF THE INVENTION

The present invention overcomes and alleviates the above-mentioned drawbacks and disadvantages in the art through the discovery of an ultrasonic pump that utilizes acoustic streaming to ultrasonically pump a medium.

Generally speaking, an ultrasonic pump of the present invention comprises a single bandwidth or broad bandwidth, non-planar transducer which radiates non-planar focused ultrasonic waves and a chamber having a large opening at the first end for receiving the medium to be pumped and a smaller opening or exit orifice at the second end for expelling the pumped from the chamber. More specifically speaking, an ultrasonic pump of the present invention not only includes a single-bandwidth or broad-bandwidth, non-planar transducer which radiates non-planar focused ultrasonic waves and a chamber for receiving therein a medium to be pumped, it further includes a housing having an entry orifice in communication with the chamber for directing the medium from outside of the housing or pump into the chamber and an outlet for communicating with the smaller opening or exit orifice at the second end of the chamber for permitting the medium to exit the chamber and housing or pump. In addition, the chamber may include a nozzle strategically positioned adjacent the smaller opening or exit orifice at the second end of the chamber at approximately the focal zone of the non-planar, focused ultrasonic longitudinal waves for further imparting momentum to the medium being pumped, so as to enhance the expulsion of the medium through the chamber and the outlet. While the chamber may be of any shape or size, so long as the chamber shape and size does not interfere with the non-planar, focused longitudinal ultrasonic waves generated by the non-planar transducer, the chamber shape and size is preferably conical or tapered and corresponds to the beam pattern of the non-planar, focused ultrasonic longitudinal waves directly generated in the medium by the non-planar transducer.

In accordance with a further feature of the present invention, the non-planar transducer is disposed at the first end of the chamber and directly produces a non-planar, focused energy wave within the medium to which momentum is imparted for pumping the medium through the chamber and then out of the exit orifice at the second end of the chamber and the outlet of the housing. In other words, the ultrasonic pump functions by directly generating non-planar, focused ultrasonic energy (ultrasonic longitudinal or traveling waves) in the medium which is absorbed by the medium for imparting momentum to the medium. Thus, momentum from the non-planar, focused ultrasonic waves is transferred to the medium as the waves are absorbed. This phenomenon is known as acoustic streaming.

In yet another feature of the present invention, a nozzle is formed with a material, such as metal, silicon, glass, etc., which conducts heat from the medium to be pumped and preferably has a melting point higher than the boiling point of such medium. Thus, as contemplated by the present invention, the nozzle will act as a heat sink to dissipate the heat generated in the pumped medium, so as to prevent the nozzle region from becoming too hot and/or melting.

In still a further feature of the present invention, the pumped medium preferably exits the exit orifice at the second end of the chamber and the outlet of the housing in the same plane, without angle as to the exit orifice and outlet, to maximize medium flow. In addition, tubing connected to the outlet of the housing is preferably made of a material, such as plastic, which has the ability to absorb and dissipate the ultrasonic longitudinal waves, so that undesired wave reflection back into the chamber following medium expulsion is minimized or prevented.

It should therefore now be apparent to those versed in this art that a general object of this invention is to provide an ultrasonic pump in which medium is caused to flow in through a flow-channel or chamber by the interaction between non-planar, focused longitudinal acoustic waves and the medium to be pumped.

It should also be apparent that another object of the invention is to provide an ultrasonic pump which has no moving parts and can easily be fabricated by machining techniques.

It is yet another object of the invention to provide an ultrasonic pump which can be integrated with control electronics.

It is another object of the invention to provide an ultrasonic pump which can be fabricated from materials which do not react with the medium being pumped.

It is still another object of the invention to provide an ultrasonic pump in which the medium flow can be electronically controlled.

Further additional objects and advantages of the invention provide an ultrasonic pump:

(1) with no moving parts which makes use of momentum transfer from acoustic waves generated from a non-planar transducer which exerts radiation force upon the medium, (2) which is equipped with a single bandwidth or broad bandwidth, non-planar transducer, preferably, but not necessarily, spherical in shape, for directly generating non-planar, focused, longitudinal traveling waves in the medium, (3) having a chamber, preferably conical or tapered in shape, which corresponds to the conical or tapered pattern of the non-planar, focused ultrasonic longitudinal traveling waves generated by the non-planar transducer for directing the medium to be pumped, (4) having a chamber which includes openings at opposite ends thereof wherein there is an inlet at one end for receiving the medium to be pumped through the chamber and an outlet at the other end for expelling the medium that has been pumped through the chamber, (5) having a chamber wherein the inlet is located approximately near or adjacent the non-planar transducer and directs the medium to be pumped into the chamber at the same or different angles in which the non-planar, focused ultrasonic longitudinal traveling waves generated by the non-planar transducer travel, (6) having a chamber whose open end adjacent the inlet is preferably of the same or similar shape and size as the non-planar transducer, (7) having a nozzle, preferably conical or tapered in shape, which is positioned adjacent or near the outlet and selectively and strategically located at approximately the focal zone of the non-planar, focused ultrasonic longitudinal traveling waves generated by the non-planar transducer for imparting additional momentum to the medium being pumped, (8) having a nozzle preferably made of a material which has a melting point greater than the boiling point of the medium to be pumped and which acts as a heat sink for conducting or absorbing heat from the pumped medium, (9) in which the medium to be pumped exits the pump in the same plane and at the same angle as the exit opening of the nozzle or chamber,

(10) having a hollow tubing connected to the pump for receiving the pumped medium exiting the pump, which is preferably made of a material which can absorb the non-planar, focused ultrasonic longitudinal traveling waves generated by the transducer from the exiting medium, so as to minimize or avoid unwanted reflection of the ultrasonic longitudinal traveling waves generated by the transducer back toward the chamber,

(11) having an arrangement of transducers using either single-bandwidth frequency range or broad-bandwidth frequency range transducers,

(12) to provide pumping action not requiring a resonant pump chamber, thereby eliminating numerous special arrangements inherent with such resonant pump designs,

(13) to provide an ultrasonic pump with complete isolation of the medium from the outside environment, to provide a pump with one chamber and with one transducer,

(14) to provide an ultrasonic pump with various frequency selections from a broad-band ultrasonic transducer to accommodate various media to be pumped,

(15) to provide an ultrasonic pump usable at high frequencies, e.g. 1 MHZ or more,

(16) to provide an ultrasonic pump without requiring a resonant mode for operation thus eliminating complex control circuitry for basic operation,

(17) to provide an ultrasonic pump either without or in combination with a lens to focus the ultrasonic waves generated by the transducer,

(18) to provide an ultrasonic pump which does not generate surface waves that are then mode converted to pump medium or fluid, and

(19) to provide a method of creating a focused zone within the pump for establishing greater energy densities within the medium for imparting larger values of momentum to the medium thus enhancing pumping action, and thereby providing with this focused surface waves that are then mode converted to pump medium or fluid, and

(19) to provide a method of creating a focused zone within the pump for establishing greater energy densities within the medium for imparting larger values of momentum to the medium thus enhancing pumping action, and thereby providing with this focused zone a well defined volume of the medium which will produce cavitation.

The foregoing and other objects of the invention are achieved by, for example, an ultrasonic pump which includes a conically-shaped or tapered chamber for directing the medium, without interfering with the non-planar, focused longitudinal acoustic waves generated directly by the non-planar transducer, to cause the medium to flow along the conical or tapered chamber in the direction of the longitudinal acoustic waves.

These and other objects, features, and advantages of the present invention may be better understood and appreciated from the following detailed description of the embodiments thereof, selected for purposes of illustration and shown in the accompanying Figs and Example. It should therefore be understood that the particular embodiments illustrating the present invention are exemplary only and not to be regarded as limitations of the present invention.

BRIEF DESCRIPTION OF THE FIGS.

The foregoing and other objects, advantages and features of the invention, and the manner in which the same are accomplished, will become more readily apparent upon consideration of the following detailed description of the present invention taken in conjunction with the accompanying Figs., which illustrate embodiments of the present invention, wherein.

Figure 5A:
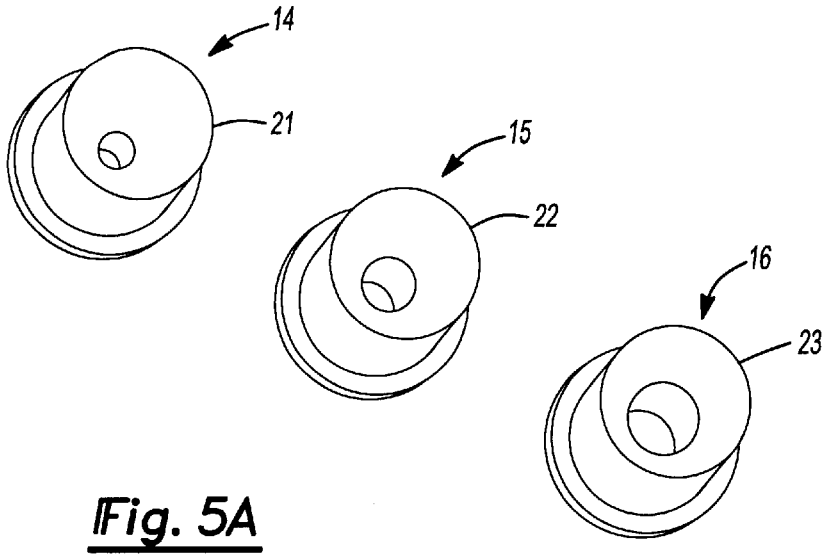
Figure 5B:
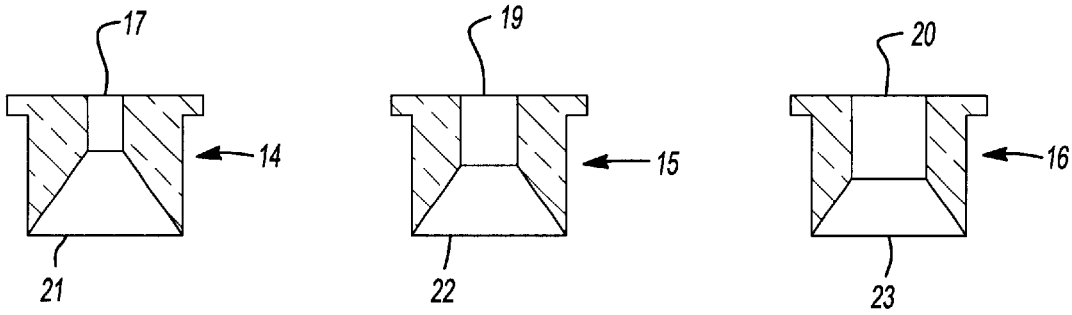
Figure 5C:
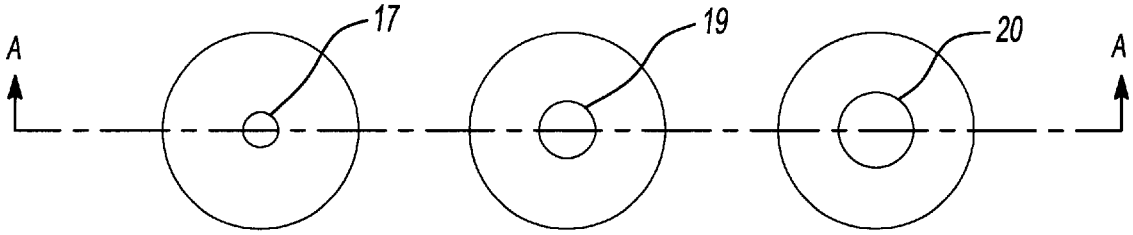
Figure 6:
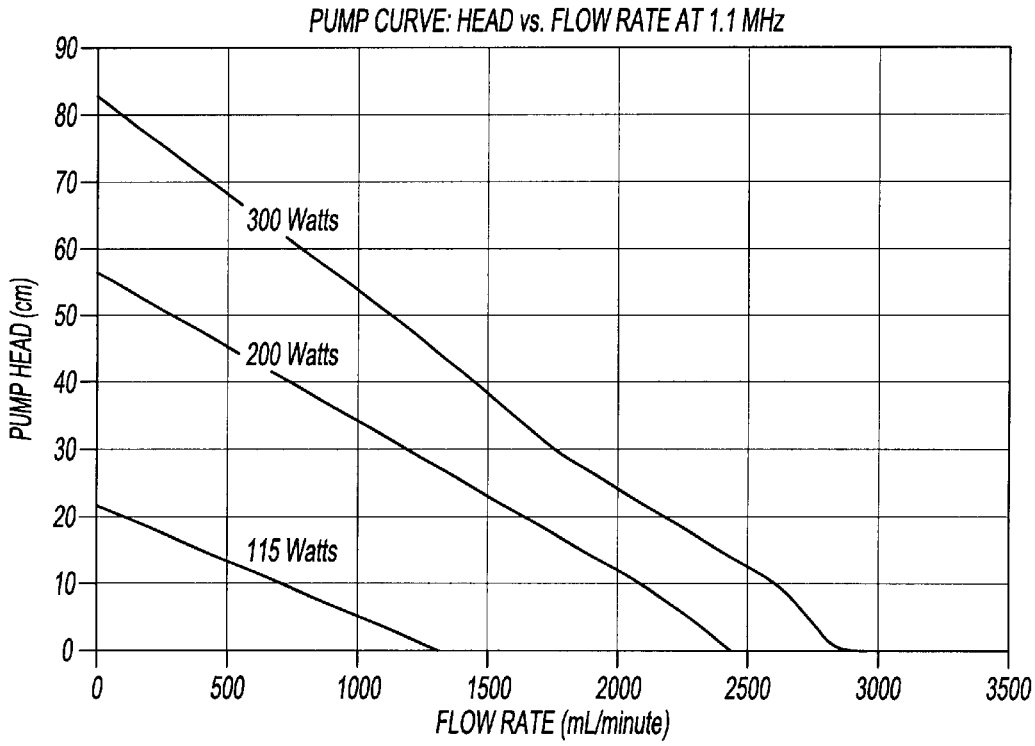

FIG. 5*a* is a perspective view of three different sized tapered-nozzles in accordance with the present invention;

FIG. 5*b* is a sectional side view of the three different sized tapered-nozzles of FIG. 5*a* in accordance with the present invention;

FIG. 5*c* is a bottom view of the three different sized tapered-nozzles of FIG. 5*a* in accordance with the present invention;

FIG. 6 are measured pump curves at about 1.1 MHZ. The flow rate is shown in milliliters/minute on the X axis, and the pump head in cm of water is shown on the Y axis. The three curves correspond to different RF input power levels to a spherical transducer as described in the Example; the first curve from left on graph is at 155 Watts, the second curve from left represents 200 Watts, and third curve from left represents 300 Watts. In all tests, the smallest orifice diameter of the tapered-nozzle is about 0.25', as depicted at 14 in FIGS. 5*a*–5*c*.

Figure 7:
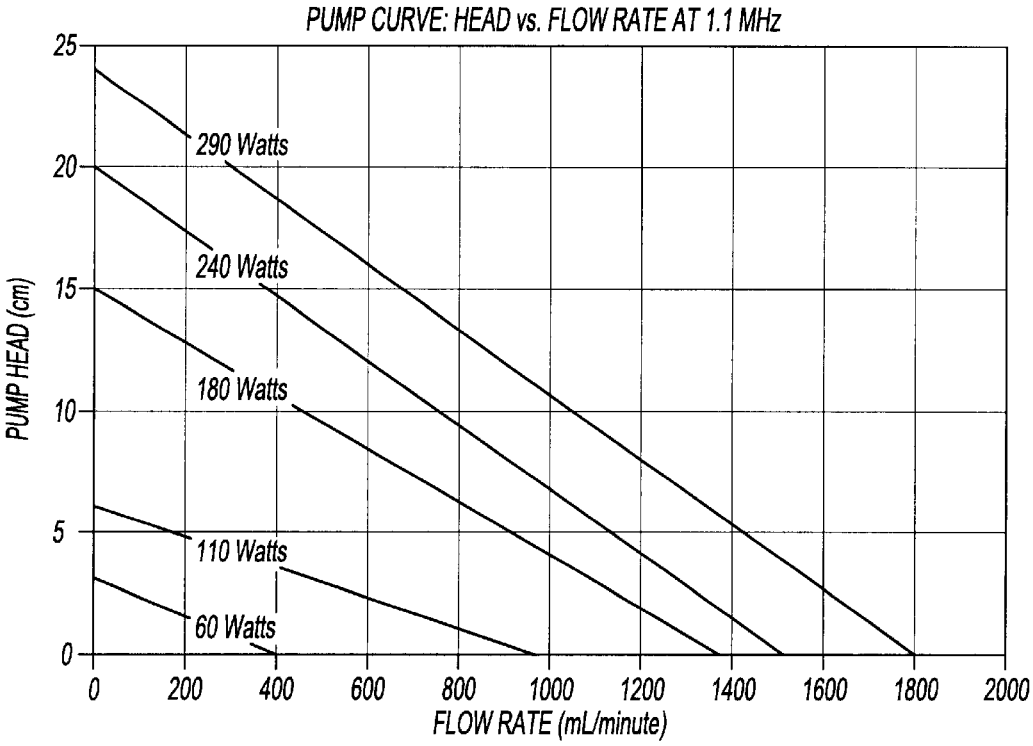

FIG. 7 are measured pump curves at about 3.3 MHZ. The flow rate is shown in milliliters/minute on the X axis, and the pump head in cm of water is shown on the Y axis. The three curves correspond to different RF input power levels to a spherical transducer as described in the Example; the first curve from left on graph is at 60 Watts, the second curve from left represents 110 Watts, the third curve from left represents 180 Watts, the fourth curve from left represents 240 Watts, and the fifth curve from left represents 290 Watts. In all tests, the smallest orifice diameter of the tapered-nozzle is about 0.25', as depicted at 14 in FIGS. 5*a*–5*c*.

Figure 8:
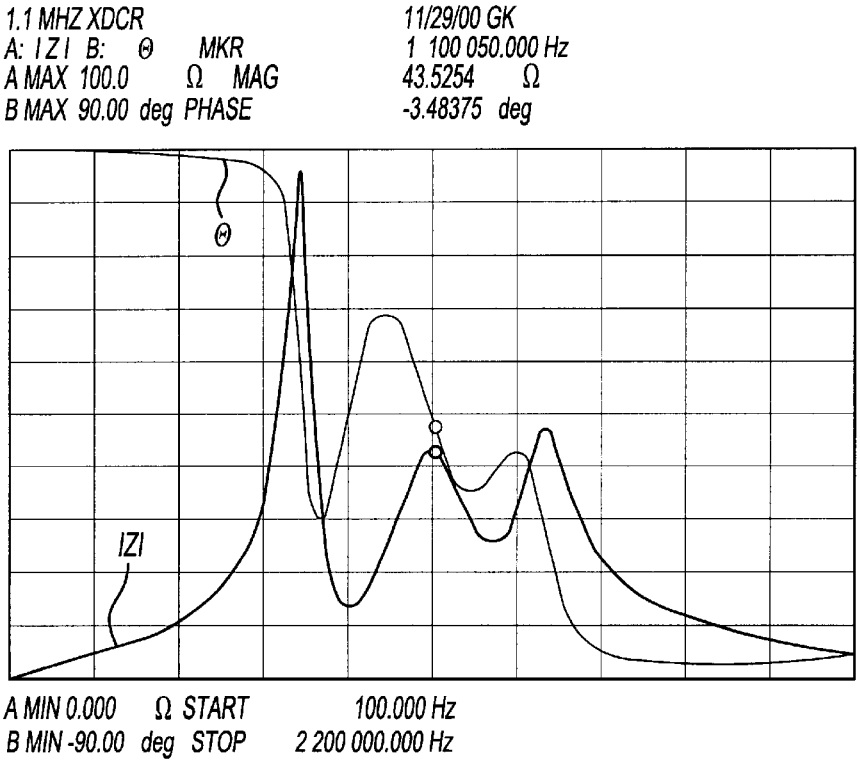
Figure 9:
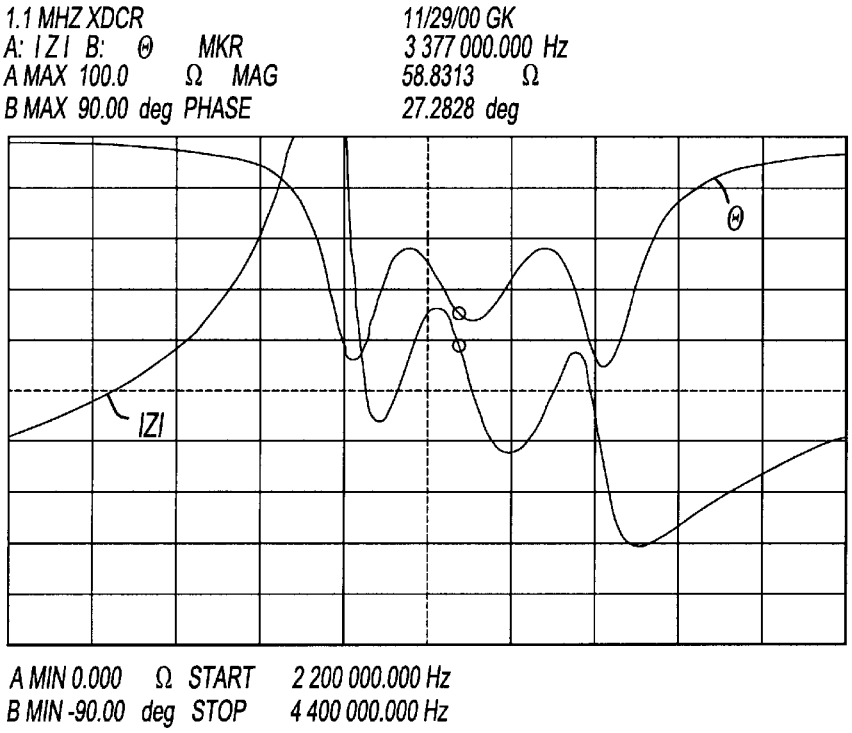
Figure 10:
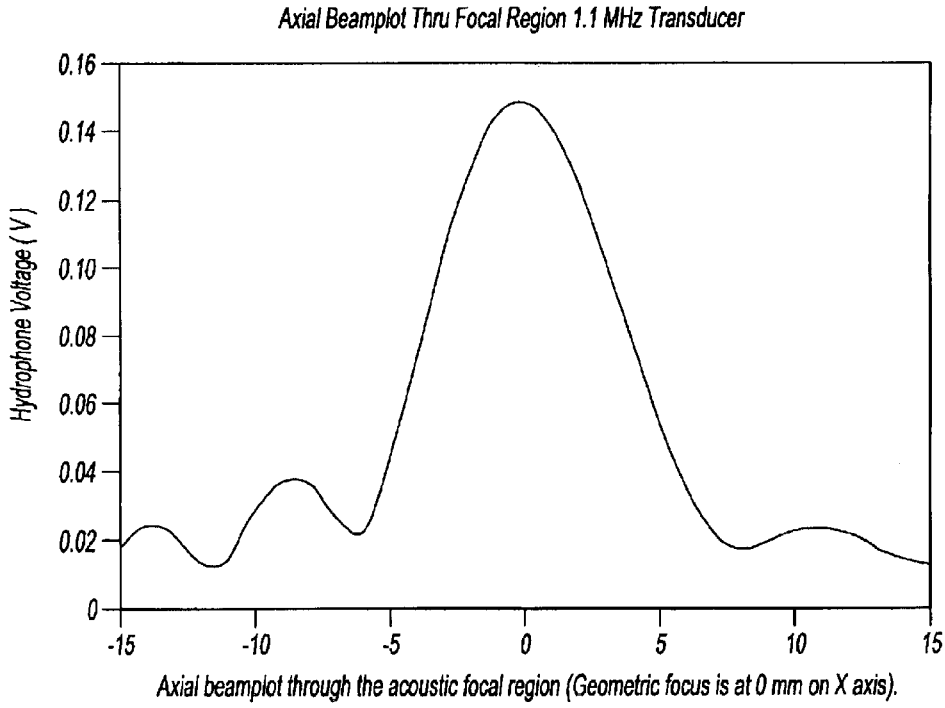
Figure 11:
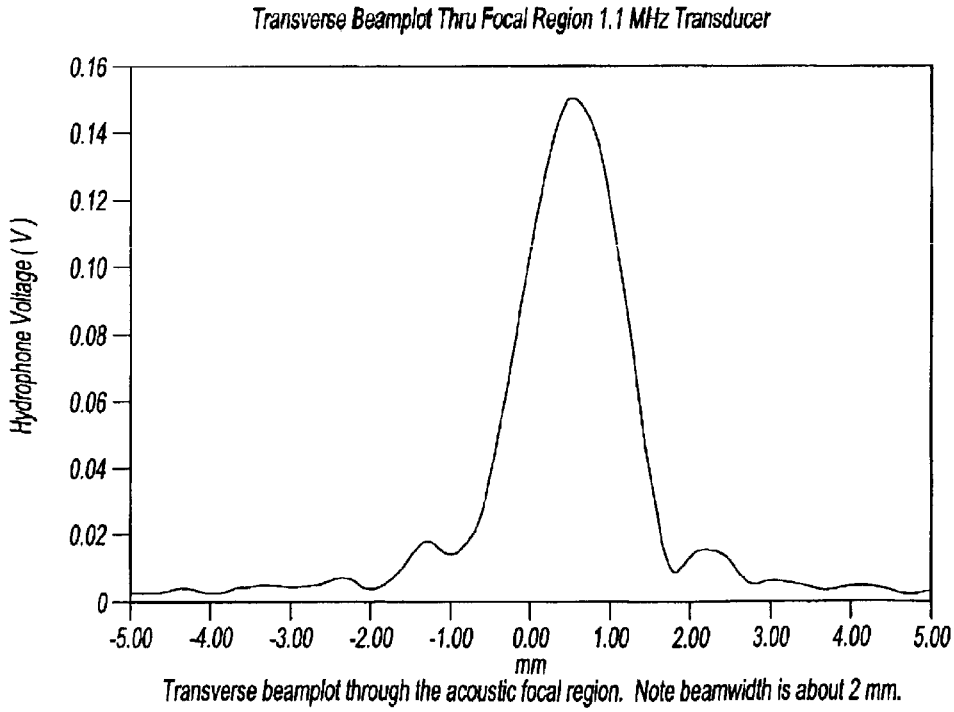
Figure 12:
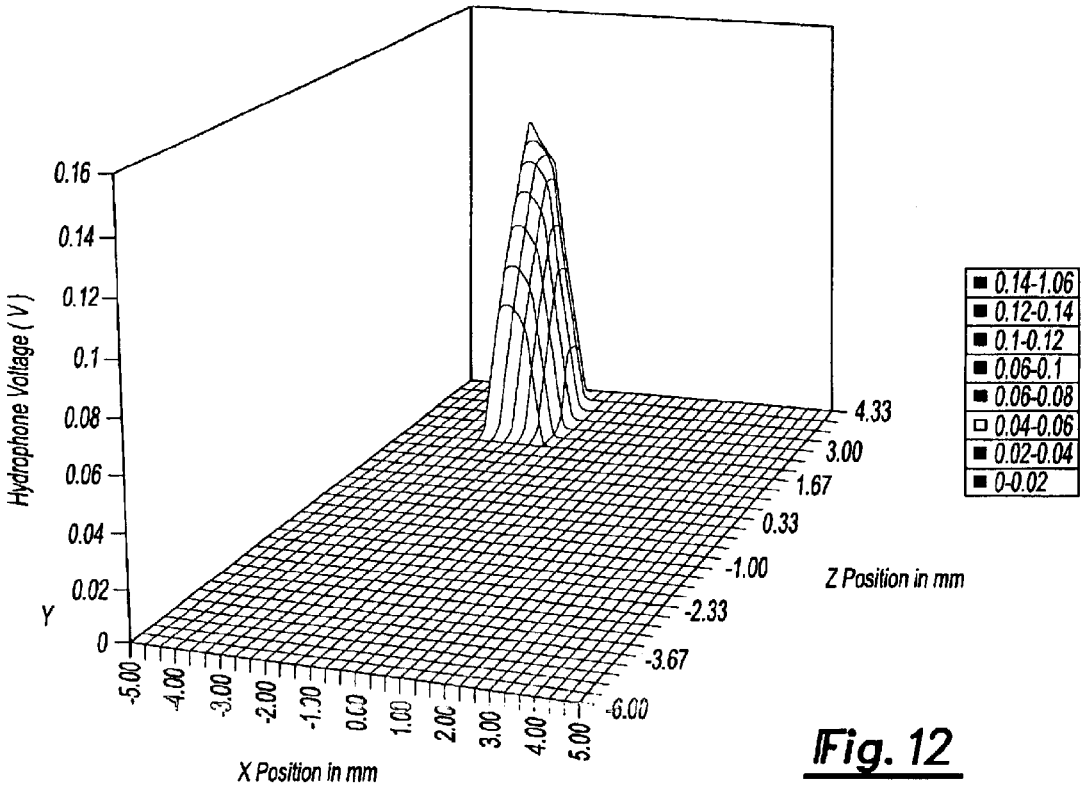
Figure 13:
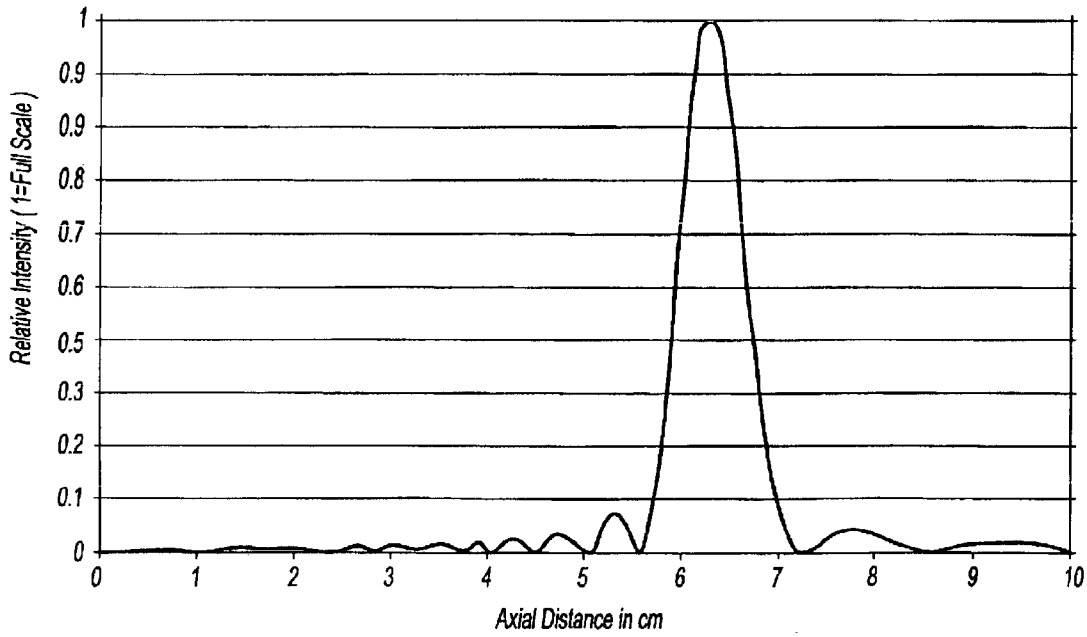
Figure 14:
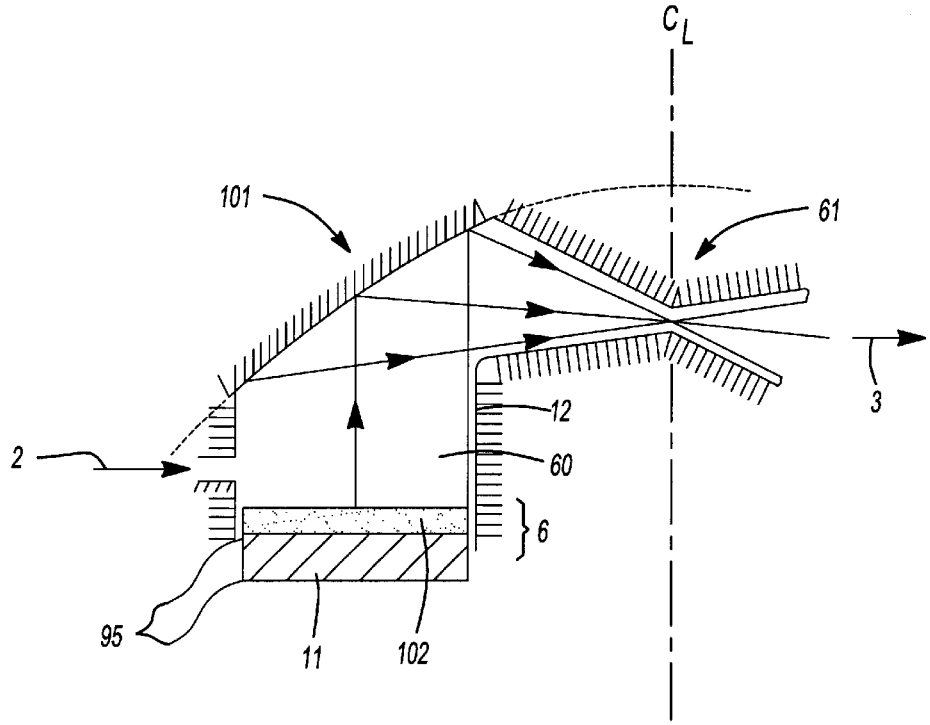
Figure 15:
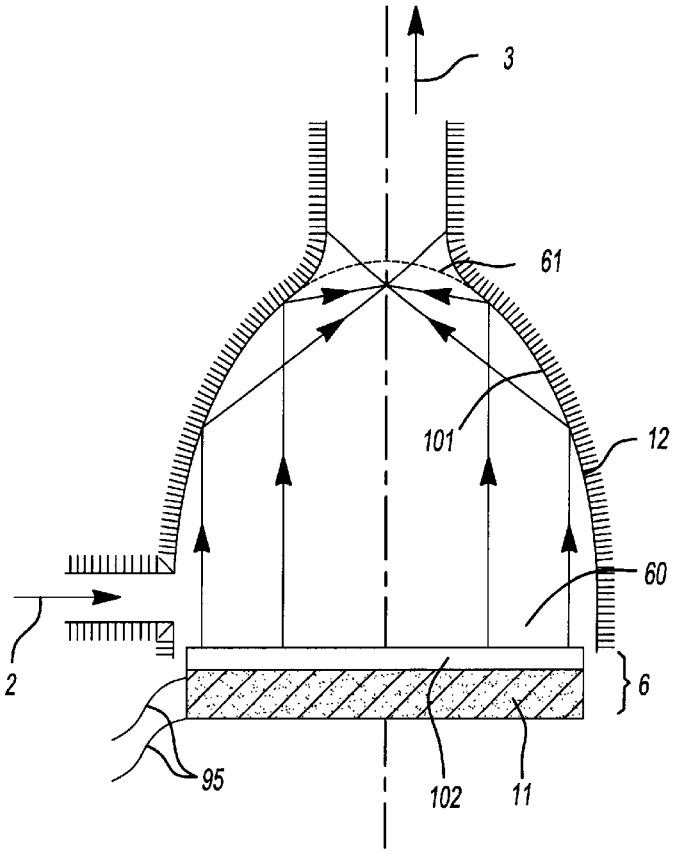

FIG. 8 illustrates impedance and phase curves of a non-planar transducer as described in Example at fundamental with match network;

FIG. 9 illustrates impedance and phase curves of non-planar transducer as described in Example at third harmonic with match network;

FIG. 10 is a measured axial beam plot through the acoustic focal region of a non-planar transducer as described in Example and in FIGS. 8–9, illustrating that the transducer is focused. Geometric focus is at 0 mm on X-axis;

FIG. 11 is a measured transverse beam plot through the acoustic focal region of a non-planar transducer as described in Example and in FIGS. 8–9, illustrating that the transducer is focused. Note beamwidth is about 2 mm. This beam plot is a slice through transverse beam plot depicted in FIG. 12;

FIG. 12 is a measured transverse beam plot through the acoustic focal region of a non-planar transducer as described in Example and in FIGS. 8–9, illustrating that the transducer is focused. Note beamwidth is about 2 mm. The hydrophone (a miniature underwater microphone that responds in the MHz frequency range) that is used to make these measurements produces a voltage output directly proportional to acoustic pressure, so the vertical scale is directly proportional to acoustic pressure on these plots;

FIG. 13 is a theoretical axial beamplot through the acoustic focal region of a non-planar transducer as described in Example and in FIGS. 8–9, illustrating that the transducer is focused. Transducer face is at 0 on the X-axis, geometric focus is at 63.2 mm. This plot shows how much greater the acoustic intensity is near the focus than elsewhere in the sound field. Acoustic intensity is proportional to the square of the acoustic pressure. Local radiation pressures are directly proportional to acoustic intensity. This illustrates that the intensity is much higher near the narrow end of the cone. This plot can be compared to the measured pressure data in FIG. 10, which covers about +/−1.5 cm around the acoustic focus. To compare directly, the values shown in FIG. 10 would need to be squared so that they are proportional to acoustic intensity;

FIG. 14 depicts a cross-sectional side view of an off-axis paraboloid focusing reflector; and FIG. 15 depicts a cross-sectional side view of an on-axis paraboloid focusing reflector.

DETAILED DESCRIPTION

By way of illustrating and providing a more complete appreciation of the present invention and many of the attendant advantages thereof, the following detailed description is given concerning the ultrasonic pumps and methods of pumping.

In accordance with this invention, medium is caused to flow along a chamber by the interaction between non-planar, focused longitudinal acoustic waves and the medium being pumped.

More particularly, medium is impelled by a pressure gradient which arises from the non-planar focused acoustic field within the medium as a result of acoustic streaming and/or radiation pressure effects. Acoustic streaming occurs as a result of absorption of acoustic energy by the medium, which transfers momentum from the traveling waves to the medium. Radiation forces occur at interfaces between two media with different acoustic properties, even in the absence of absorption. Radiation pressure results from local differences in energy density in the traveling acoustic wave. The energy density of a traveling wave depends upon the velocity of propagation. For the same ultrasonic intensity level, a slower sound velocity increases the density of the traveling acoustic energy, and a higher velocity decreases the energy density. Thus, radiation pressure is inversely related to the velocity of propagation in the medium. This can be illustrated by propagating an ultrasonic wave from water into another immiscible medium with a much slower sound velocity, such as carbon tetrachloride or a perfluorocarbon liquid. If the wave is traveling from water into the slow medium, the radiation force that results displaces the interface towards the water side (i.e., toward the source of ultrasound). If the wave is traveling from the slow medium into the water, the resulting force displaces the interface towards the water side again, but this time it is away from the source of ultrasound. The medium displacements at the interface are complex as a result of the sound field structure and the surface tension at the interface, but generally one can visually observe a pattern representing the ultrasound beam pattern at the interface. At high power levels, acoustic streaming can occur prior to the interface, and this can also cause ejection of medium at the interface.

Absorbing a traveling ultrasonic wave that is incident upon a lossy material such as a rubber compound effectively results in zero acoustic energy density on the absorber side of the interface. In this case, the radiation force on the absorber is always toward the absorber surface. For a wave traveling in water at room temperature and with a perfect absorber, the radiation force is equal to about 67 milligrams per acoustic Watt. This force is commonly measured using a suitable balance arrangement (termed a radiation force balance) in order to quantify the amount of ultrasonic power present in a given ultrasound field.

These effects are difficult to separate in an ultrasonic pump in which media are pumped by non-planar, focused longitudinal acoustic waves traveling through a chamber. Acoustic streaming requires attenuation to occur, while radiation pressure is present at interfaces between media of different acoustic impedances. Radiation pressure can also be induced by causing a gradient in pressure either by a change of the intensity or the velocity of the wave. Classical examples of radiation pressure involve sound waves in one medium incident on an interface with another medium. This causes a reflection of the sound and a difference in intensity across the interface. The resulting pressure difference causes mound formation or medium ejection in the direction of lower radiation pressure.

As will be apparent from the description to follow, pressure gradients provided by acoustic streaming and radiation pressure are used to pump a medium through a chamber in controlled amounts.

It should also be apparent that, in the Figs., like reference numerals are used to indicate like elements.

As used herein, the term "medium" is used herein in a broad sense and is meant to refer to any fluid or non-solid material, such as a liquid, a liquid metal, a gas, an aerosol and the like, that is not too viscous to be pumped in accordance with the present invention. Examples of preferred media that are not too viscous concern those media having a viscosity comparable to about 5,000 centipoise or less. Preferably, the media has a viscosity of approximately 100 centipoise, which is the viscosity of water, or less.

Figure 1:
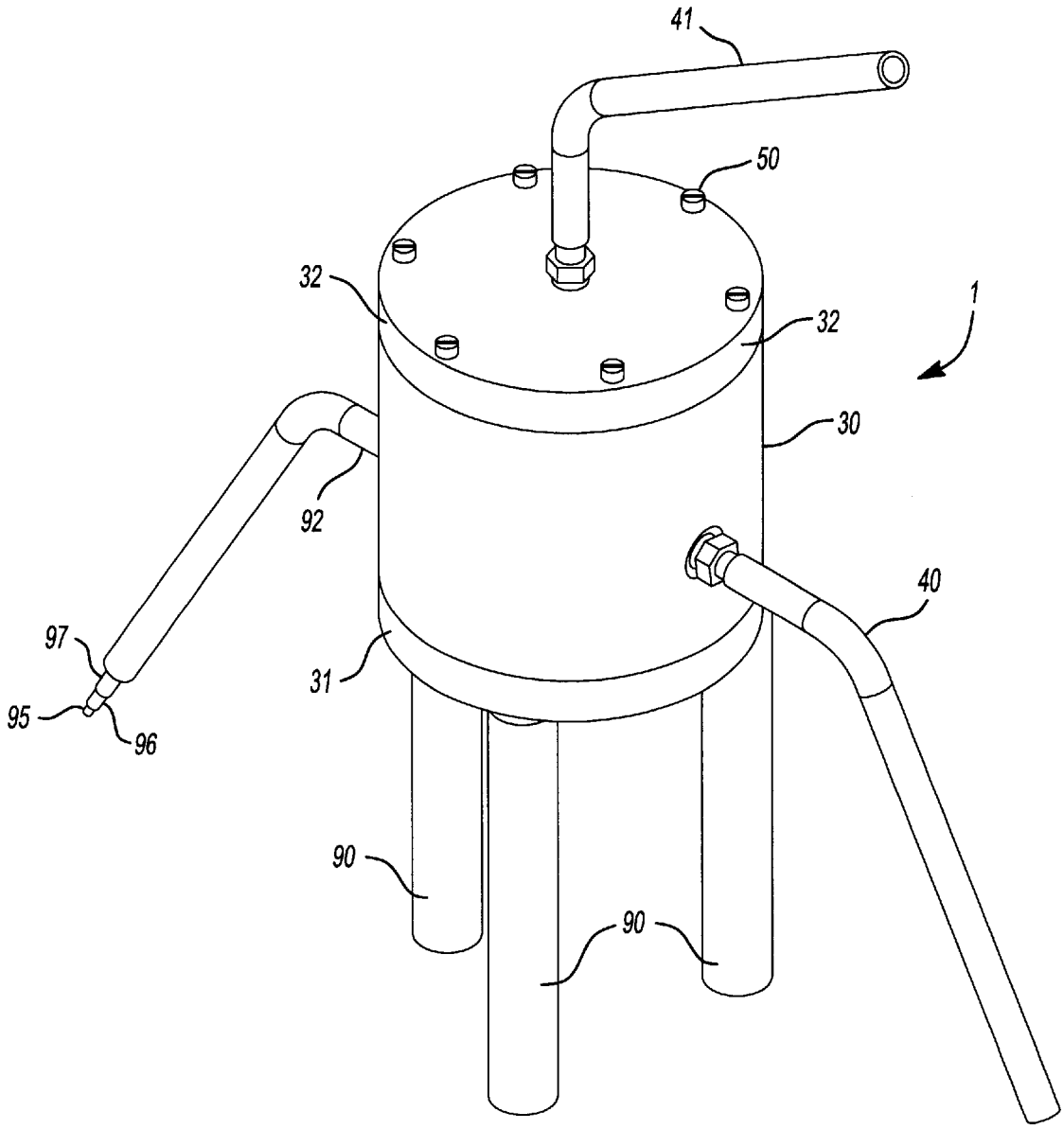
FIG. 1 is a perspective view of an ultrasonic pump in accordance with the present invention.
Figure 2:
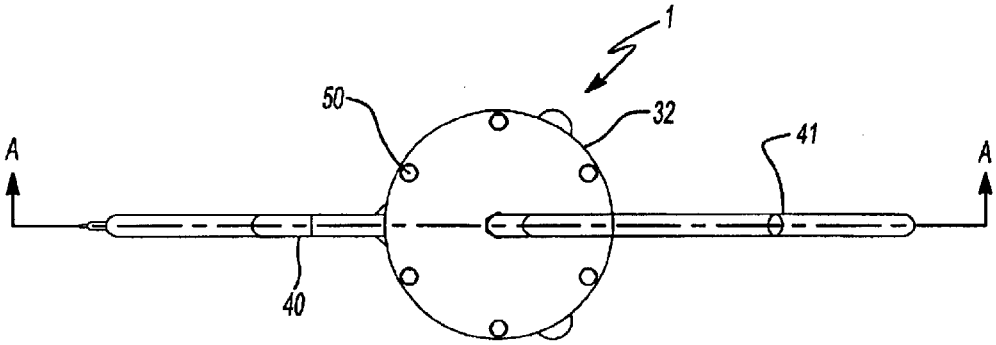
FIG. 2 is a top plan view of the ultrasonic pump of FIG. 1 in accordance with the present invention.
Figure 3:
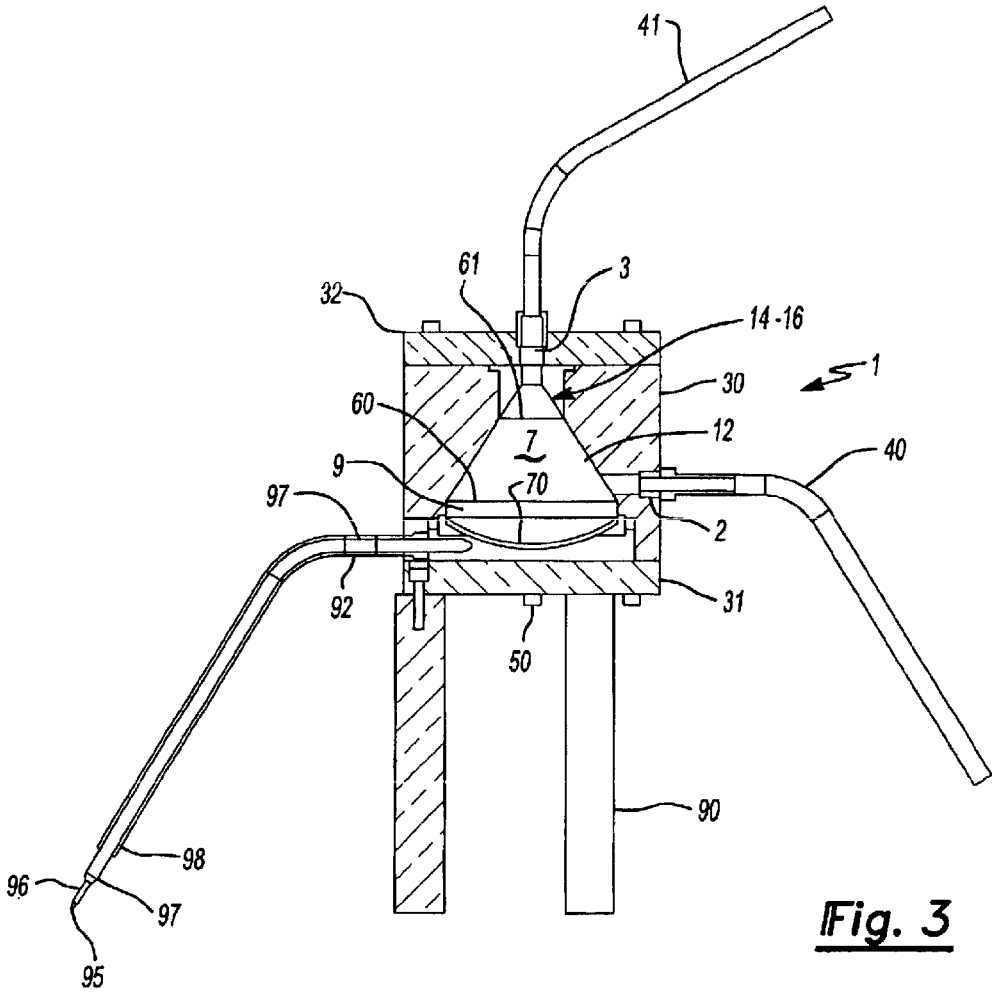
FIG. 3 is a sectional side view of the basic structure of the ultrasonic pump of FIG. 1 in accordance with the present invention.
Figure 4:
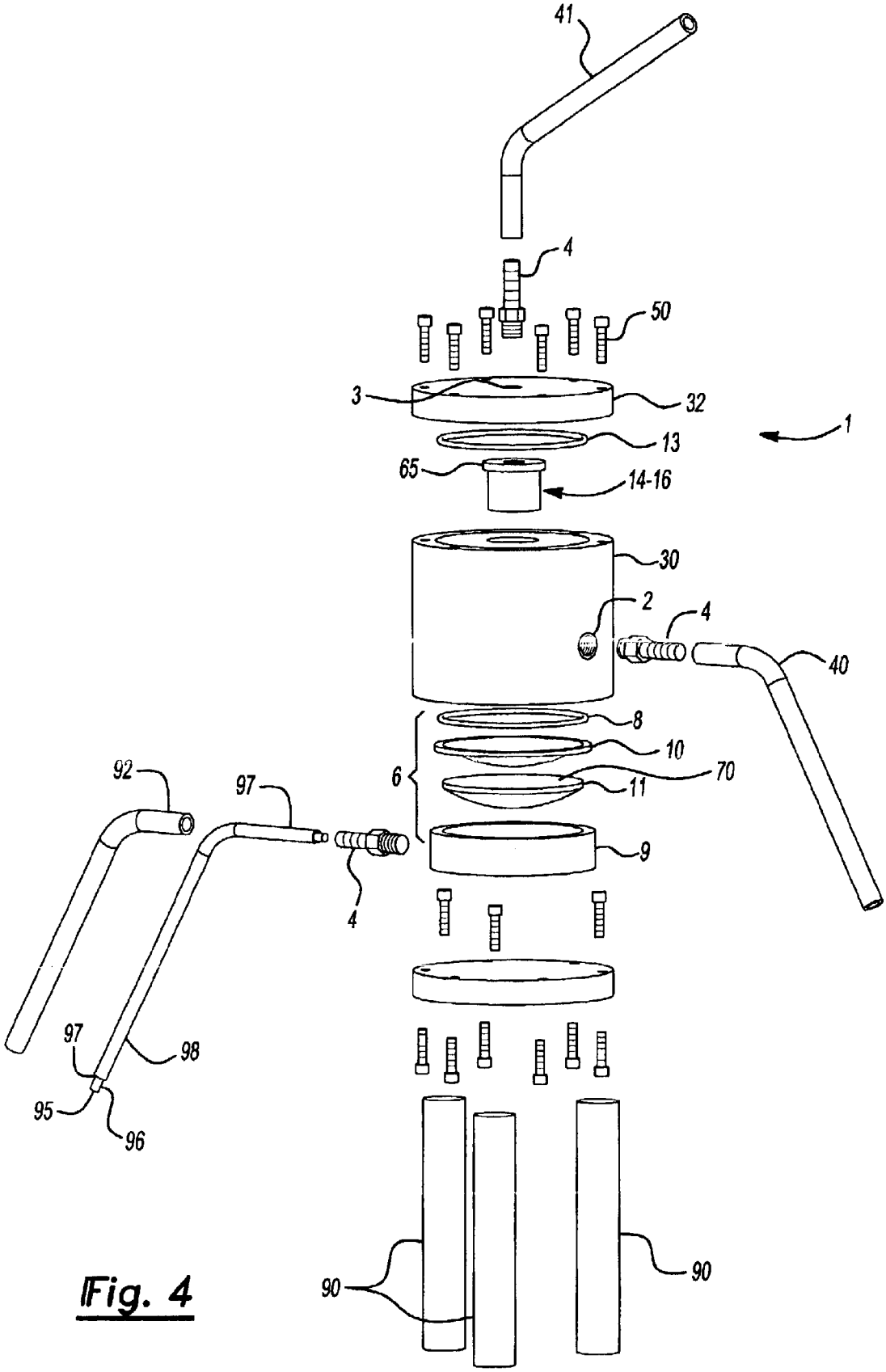
FIG. 4 is an exploded perspective view of an ultrasonic pump of FIG. 1 in accordance with the present invention.

An ultrasonic pump 1 is shown in FIGS. 1–5*a*–5*c*. Turning now to FIGS. 1–4, the ultrasonic pump comprises a housing 30 having an inlet or inlet port 2 in communication with an entry orifice 60 positioned near or adjacent the first or larger diameter-end opening 61 of chamber 12 for permitting entry of a medium 7 into chamber 12 through inlet tubing 40, and an outlet or outlet port 3, which is disposed at or near the second or smaller diameter-end opening 61 of chamber 12, which allows medium 7 to exit or pass from said chamber 12 through outlet tubing 41. Inlet and outlet tubing 40 and 41, respectively, can be connected to inlet or inlet port 2 and outlet or outlet port 3, respectively, through hose barb fittings 4, as depicted in FIGS. 1, 3–4.

As further illustrated in FIGS. 1 and 3–4, housing 30 is supported by four individual legs 90, and coax tubing 92 is connected to housing 30 through hose barb fitting 4. As further illustrated in FIGS. 1 and 3–4, coax cable conductor 95, coax cable insulator 96, coax cable shield 97, and coax cable jacket 98 are surrounded by coax tubing 92. It should be understood that coax cable conductor 95 is connected to conventional electronic drive circuitry (not shown).

In operation, as medium 7 is pumped through chamber 12, medium 7 absorbs the non-planar, focused acoustic radiation pressure generated by a non-planar transducer assembly 6 disposed at the first or larger diameter-end opening 60 of chamber 12.

The non-planar transducer assembly 6 includes a face plate 10, a disc 9 and a non-planar, e.g., a spherical or other-shaped, transducer 11, as depicted in FIG. 4. The non-planar shaped transducer assembly 6 is driven by the conventional electronic drive circuitry (not shown) which generates radio-frequency electrical signals to power the non-planar transducer assembly 6 to form an acoustic source for providing an acoustic radiation field which radiates ultrasonic energy into the medium 7. The electronic drive circuitry (not shown) is connected to an electrical power source (not shown) through conventional electrical terminals (also not shown).

An O-ring 8 is disposed along the periphery of transducer assembly 6 and the bottom periphery of housing 30 to prevent medium leakage, as illustrated in FIGS. 3–4. The non-planar transducer 6 is electrically stimulated by conventional circuitry and it in turn vibrates at its natural resonant frequency. It should be understood that the transducer assembly 6 may be either a high-Q narrow bandwidth type or a low-Q broad bandwidth type; but, the transducer assembly 6 is not restricted to only these types. In the broadest sense, the non-planar transducer assembly 6 may, in general, be any transducer assembly that can effectively transform electrical energy into mechanical energy to accomplish the objectives of the present invention.

It therefore should be appreciated that, while spherically or round in shape transducers can be used in accordance with the present invention, the present invention also contemplates transducers that are non-spherical in shape or electronically-focused elements, wherein different annular segments of the elements are driven at different electrical phases (to achieve a similar phase distribution across the wave-front as one gets from the spherical element).

The transducer assembly 6 emits non-planar, focused ultrasonic waves into medium 7, which travels away from the transducer surface 70 and into chamber 12. As the traveling waves interact with medium 7 through absorption, scattering and nonlinear propagation, momentum is transferred from the waves to medium 7 as the wave energy is absorbed by medium 7. This interaction produces acoustic streaming, causing medium 7 to flow in the direction of wave propagation, away from the acoustic source or transducer assembly 6. Thus, the transducer assembly 6 generates non-planar, focused longitudinal acoustic waves, which travel through chamber 12 responsive to frequency input. It should be understood that only one transducer is required for unidirectional pumping.

In the present embodiment, while the active diameter of the transducer assembly 6 is comparable or similar to the larger diameter end 60 of chamber 12, it is preferably slightly smaller than the larger diameter 60 of chamber 12 at its largest point. In other words, larger diameter end 60 of chamber 12 is made slightly larger than the active diameter of transducer assembly 6, so that the central portion of the focused ultrasonic field lies entirely within chamber 12. Chamber 12 is not required for acoustic focusing. Rather, its function is primarily hydrodynamic; that is, it contains the medium 7, so that medium 7 while being acted upon by the sound field, cannot escape to the sides. The chamber 12 also acts to reduce the medium cross-section to match the beam shape of the focused sound field. This results in a medium jet on-axis as medium 7 passes through the region of highest acoustic intensity, at the focus of the sound field. This is believed to maximize the momentum transfer into the smallest amount of medium volume to provide the greatest forward momentum to medium 7 and to improve the pumping performance.

A focusing chamber in accordance with the present invention for directing the medium being pumped through chamber 12 will now be described.

FIGS. 5*a*–5*c* depict tapered-nozzles 14, 15 and 16, respectively, disposed at the second end, the smaller diameter end 61, of conically-shaped pumping chamber 12, which serves to steer or focus medium 7 flow gradient and the acoustic radiation in a concentrated direction which is opposite that of the transducer assembly 6. As shown in FIGS. 5*a*–5*c*, the lengths of the tapered-nozzles 14, 15 and 16 are about 0.9180". At one end of each tapered-nozzle 14, 15 and 16 is a brim or seat 65 having an exterior diameter of about 1.25" for seating within a complimentary recess (not shown) in housing 30. The diameters of exiting orifices 17, 19 and 20 of tapered-nozzles 14, 15 and 16, for medium 7 exit may vary in size, e.g., ¼", ⅜" or ½" depending upon the medium being pumped, the ultrasonic pump application, and the focal zone location of the non-planar, focused longitudinal waves generated by the transducer assembly 6. Medium entry orifices 21, 22 and 23 lengths of the tapered-nozzles 14, 15 and 16 may have a diameter corresponding to the second end or smaller diameter-end opening 61 of conically-shaped pumping chamber 12, e.g., about 1.01". The tapered-nozzles 14, 15 and 16 uniquely establish very high radiation energy densities, which reduce the total chamber path length, otherwise required to achieve the necessary momentum interaction.

While FIGS. 5(*a*)–(*c*) illustrate tapered-nozzles 14, 15 and 16, as constituting individual components separate from chamber 12, it nevertheless should be understood by those versed in this art that chamber 12 can be integrally formed with a tapered-nozzle section formed of similar or dissimilar material. In either configuration, it should be understood by those skilled in this art that the exit orifices 17–19 of chamber 12 is the end orifice of chamber 12 and should be strategically located at about the focal zone of the focused waves generated by the transducer assembly 6. It should be further appreciated by those of skill in this art that when with a tapered-nozzle section is integrally formed as part of chamber 12, the second or smaller diameter-end opening 61 of chamber 12 is the exit orifice having a selected diameter and strategically located at about the focal zone for accomplishing the same function as the exit orifices 17–19 of tapered-nozzles 14, 15 and 16.

It should be appreciated by those versed in this art that chamber 12 is not necessarily a focusing chamber. It also should be appreciated by those versed in this art that the sound field produced by the transducer assembly 6 will be nearly identical with or without chamber 12 in place or assembled into housing 30 of pump 1. The transducer assembly 6 is providing the focusing, and chamber 12 is designed to keep medium 7 in the focused sound field or beam. While you can operate pump 1 with chamber 12 removed, a medium jet (similar to a drinking-fountain stream) will result; however, it won't be as directed or coupled into tubing 41.

The diameter of the tapered nozzles 14, 15 and 16 should match the beam width of the focused ultrasound field generated by transducer assembly 6 for optimal pumping. It is believed that the diameter of tapered nozzles 14, 15 and 16 does not have much to do with the medium being pumped. For a spherically-shaped transducer assembly 6, the beam width at the focus is given by:

Beam width=1.22 (focal length) (wavelength)/(diameter).

This is the full beam width to the half-pressure (or quarter-intensity) points, and also known as the −6 dB beam width. In the case of the pump, you would want to go out a little further, to include some of the side lobe energy so that it is not wasted. In the present example:

Wavelength=sound velocity/frequency=(about 1485 m/sec)/(about 1.1 MHZ)=about 1.35 mm;

Focal length=about 63.2 mm (=the radius of curvature);

Diameter=about 70 mm; and

Beam width=1.22*63.2*1.35/70= about 1.49 mm.

The optimal pump opening would be on the order of 1.5 to 2.5 times the beam width (to include some of the side lobe energy). This works out to 2.2 to 3.7 mm. It is believed, however, that a smaller orifice would improve pump performance even more.

Tapered nozzles 14, 15 and 16 are preferably made from metal to avoid issues of melting associated with plastic materials in the vicinity of the acoustic focus. Aluminum is a good choice, but it is believed that many other materials should work equally as well, e.g., brass, stain-less steel, and any other suitable metals or materials. Ceramics can also be used, but may erode by cavitation. High-temperature plastics, such as polyetheretherketone (PEEK) or polyetherimide, which have melting points far above the boiling point of water, may be suitable materials as well. Thus, it should now be appreciated by those versed in this art that the metal or material selected to construct tapered nozzles 14,15 and 16 and chamber 12, particularly when a tapered nozzle is integrally formed or molded as part of chamber 12, should have a melting point far above the boiling point of water or the medium selected to be pumped.

The tapered nozzles 14,15 and 16 are not intended to have an acoustic function, although they may reflect any stray energy back towards the centerline.

While tapered nozzles 14,15 and 16 are depicted in FIGS. 5*a*–5*c* as individual, removable and interchangeable components, it should be understood by those skilled in this art that the present invention also contemplates that a tapered nozzle can be molded as part of or integrated into chamber 12 to form one homogenous part.

Ultrasonic pump 1, as shown in FIGS. 1–4, comprises an outer housing 30 with removable bottom cover plate 31 and a removable top cover plate 32. Removable bottom cover plate 31 is disposed over the first or larger diameter-end opening 61 of conically-shaped chamber 12, transducer assembly 6 and O-ring 8. Removable top cover plate 31 is disposed over the second or smaller diameter-end opening 61 of conically-shaped chamber 12, the exit orifice of a tapered nozzle and O-ring 13. O-ring 13 is disposed along the top periphery of housing 30 to prevent medium leakage, as illustrated in FIGS. 3–4, especially during pumping. Removable top and bottom plates 31 and 32, respectively, are connected to housing 30 via screw bolts 50. Preferably, there is a finish polish on inside and outside surfaces of housing 30.

As the ultrasonic intensity increases near the acoustic focus, wave propagation in medium 7 becomes increasingly nonlinear. Non-linearities arise because the velocity of wave propagation is a function of pressure, and the compressional half-cycle of the wave travels slightly faster than the rarefactional half-cycle. These effects accumulate as the wave travels, altering an initial sinusoidal wave-shape into a waveform containing both even and odd higher harmonics. In the most extreme case, near the focus, the compressional wave-fronts may become quite steep, with nearly instantaneous pressure jumps at their leading edges. This is termed a shock waveform. The region where significant nonlinear effects occur increases as the power level is increased, moving backward from the focal region toward the transducer assembly face. In the region of nonlinear interaction, the harmonic energy is absorbed much more rapidly by the frequency-dependent attenuation by the medium being pumped. Nevertheless, it is rapidly regenerated by the non-linear effects. Thus, the nonlinear effects serve to more rapidly transfer energy from the non-planar, focused traveling waves to the medium being pumped and, thus, to rapidly generate momentum in medium 7 in a short distance around the focus.

In addition, high ultrasonic intensity levels can cause acoustic cavitation to occur near the focus. Cavitation results when the negative (rarefactional) portion of the pressure waveform produces pressures sufficiently low for a sufficient time to cause medium 7 to vaporize. This is believed to be similar to cold boiling that results when a vacuum is applied to a medium in a vacuum chamber, except here the dynamic negative pressures are well below that of a vacuum, and the boiling can rapidly occur within the negative portion of the wave (approx. 450 nanoseconds at about 1.1 MHZ). Once the bubbles are formed, the bubbles grow to a resonant size by rectified diffusion of dissolved gas and water vapor. As they grow in size, the sound field and moving medium increasingly act together to force the bubbles in the direction of medium flow.

Another alternate design contemplated by the present invention includes reflective focusing, which involves the use of reflective surfaces rather than refractive lenses to focus the ultrasound. It is believed that reflective focusing has the distinct advantage that allows an ultrasonic pump of the present invention to use flat piezoceramic, which is much cheaper to manufacture. See FIGS. 14 and 15. In accordance with the present invention, the reflector 101 can be made from a material with an acoustic impedance much higher than water, so that nearly all the acoustic power is reflected. Suitable materials include metals, such as brass, stainless steel and other suitable high-density, high-modulus alloys. In addition, ceramics represent a suitable material, preferably, high density and high modulus ceramics to yield the highest acoustic impedance. Glass and quartz materials may also be useful in some applications, but they do not have acoustic impedances as high as the metals and ceramics. Quartz is a particularly desirable material for semiconductor applications because it will withstand a wide variety of harsh chemicals and it is considered to be a "clean" surface that does not generate particulates.

In the case of piezoelectric transducers, the transmit (electric to acoustic)and receive (acoustic to electric) efficiencies, i.e., transduction or electroacoustic efficiencies, are often differing values and both can have importance in many applications. The transmit and receive efficiency functions can be defined as:

Transmit Efficiency=Acoustic Power Into Load Medium/Electric Power Into Transducer Receive Efficiency=Electric Power Into Receiver/Acoustic Power Into Transducer Note that the transduction or electroacoustic efficiency functions are unaffected by immittance mismatches on the power source side, since the denominator in either case is the amount of power that actually went into the device. They are, however, affected by mismatch on the load side. Thus, it is critically important that the transducer be acoustically well-matched to the load medium (typically water). Since these are power ratios, they are scalar quantities versus frequency. Both functions have a theoretical maximum of 1, since there is no power gain in the transducer.

To achieve the highest possible transduction or electroacoustic efficiency, it is necessary to use an acoustic impedance matching layer 102 between the piezoceramic element and the load. These layers are nominally a quarter-wavelength thick at the center frequency, as measured using the sound velocity in the matching layer itself. For continuous-wave (CW) operation, the acoustic impedance of the layer is chosen to be close to the geometric mean of the acoustic impedances of the piezoceramic and the load medium. For a typical piezoceramic, the acoustic impedance is about 34 MRayls, the water is 1.485 MRayls (at room temperature), and thus the ideal matching layer impedance is sqrt(34*1.485)=7.1 MRayls.

In practice, a variety of suitable materials and thicknesses can be used for this matching layer 102, such as epoxies loaded with dense fillers (e.g., tungsten or nickel powders, tungsten boride, tungsten oxide in the form of a fine powder, −325 mesh, etc.).

Furthermore, if an acoustic lens is used, it is necessary that the lens material not interfere with efficient coupling of acoustic energy into the load medium. This requires that the acoustic lens be one of the following:

1. High-impedance lens material, in direct contact with piezoceramic, with an acoustic impedance matching layer 102 between the lens and the load medium (e.g., water); or
2. Low-impedance lens material, in direct contact with the matching layer 102, with an acoustic impedance close to that of the load medium.

A high-impedance material would ideally have an impedance of 20 to 40 MRayls, a high sound speed (as is typical of materials in this impedance range), and low internal losses. Aluminum (Z=17.3 MRayls) is sometimes used, although it is less than ideal. In this case, the aluminum would need to have a matching layer 102 between it and the load. For a water load, the matching layer would need to have an impedance of about sqrt(17.3*1.485)=5.1 MRayls. This is readily achieved using filled epoxies (as described above).

A low-impedance lens material would ideally have an impedance comparable to the load medium (1.485 in the case of water). For a high-velocity lens, hard plastics with a low density and low acoustic losses are used. Examples include polymethylpentene (Mitsui TPX DX-845) and cross-linked polystyrene (Rexolite). For a low-velocity lens, soft plastics with a high density and low losses are used. Examples include various silicones (McGhan Nusil R2560, GE RTV 31). Using either high- or low-velocity lenses, a matching layer is still needed between the piezoceramic and the lens material for maximum efficiency. This layer has similar requirements to the lensless case described above (approx. Z=7.1 MRayls).

In this alternative embodiment, transducer 11 of transducer assembly 6 may be of any shape, although typically it is preferably circular, square, or rectangular. A suitable transducer for this configuration can be a conventional, high-efficiency power ultrasound transducer. This generally requires a low-loss lead zirconate titanate piezoceramic, such as Channel 5800, Channel Industries, Santa Barbara, Calif., with an acoustic impedance matching layer, typically one-quarter wavelength in thickness, filled with an epoxy.

Chamber 12 within a pump body (not shown) serves primarily to guide the medium to keep it within the sound field near the focus or focal zone and the smaller diameter-end opening or exit orifice 61. The preferable shape of chamber 12 will substantially correspond to the boundaries of the acoustic field. Chamber 12 may be made from a wide range of materials, such as metals, glass, ceramic, or plastic. The material of choice is likely to depend upon the medium to be pumped and the application's contamination requirements. For high flow rate applications, the larger diameter-end opening 60 of chamber 12 is necessarily made from a material that will withstand the high-intensity ultrasound field, and reflect any stray ultrasound energy back into the focal region or pattern. Materials with high thermal conductivity and high strength, combined with low ultrasonic absorption are preferred. Metals, such as aluminum, brass, and steel, are candidates for high-power pumps. Glass or quartz are also candidates, albeit with poorer thermal conductivity, particularly in cases where the medium to be pumped is corrosive and contamination is of primary concern. In more moderate power applications, chamber 12 may be made from a plastic with low ultrasonic losses and a high melting point, such as polyetherimide (GE Ultem 1000).

Thus, it should be now appreciated by those versed in this art that an ultrasonic pump is disclosed without using any moving mechanical parts. An ultrasonic pump of the present invention uses acoustic radiation forces to transfer momentum by elastic and inelastic collisions of phonons to the medium (fluid molecules) resulting in a flow gradient of the medium in a resultant direction opposite the acoustic energy source (transducer assembly 6). As contemplated by the present invention, the ultrasonic pump can be miniaturized, the medium is totally isolated from the transducer, and the ultrasonic pump is silent with no conventional vibration.

The ultrasonic pump can be used as a direct replacement for any conventional pump application and uses far less electrical energy for an equivalent mechanical pumping operation. If it does fail in operation, it can be easily repaired by replacing the few parts needed for operation, namely, either the drive electronics or the acoustic transducer itself. Furthermore, using micro-electronic circuitry, the transducer assembly 6 and its associated drive electronics can be integrated into one hybrid component, truly allowing for a pump system with two major parts; a transducer assembly and the pump housing into which a chamber is assembled. The main housing and the chamber can each be a single molded or machined part and as such would not fail, for it is simply a metal or plastic housing which encloses a chamber. Such a solid state pump functions via the momentum imparted by a ultrasonic transducer assembly 6. However, it should be understood that the ultrasonic pump of the present invention may include for its operation other suitable methods of generating ultrasonic radiation forces as long as the objectives set forth herein are not defeated.

To understand the mode of operation of an ultrasonic pump of the present invention, one must consider the phenomenon of a nondissipative fluid. A medium selected to be pumped can be treated as a continuous one. This approximation is believed to be at all times valid, except for an extremely rarefied gas, or for a solid when the wavelengths of the waves are comparable with the inter atomic distances.

When a sound wave is propagated, the particles making up the pumping medium are displaced from their rest or equilibrium positions. If the displacement of the particle is along the line of the direction of propagation of the wave, we call the wave longitudinal. Sound waves propagating in a medium are longitudinal in character. If these displacements are at right angles to the direction of propagation of the wave, the wave is termed transverse. Transverse waves can occur in highly viscous liquids, but their importance in acoustics is believed to be primarily limited to sound waves in solids.

According to a general form of the present invention, the responsive element of the ultrasonic pump is an ultrasonic source in general. It should be appreciated that the ultrasonic source may be a specific source, such as a piezoelectric transducer, an electrostriction transducer, and thin- or thick-film piezoelectric transducers.

In order to further illustrate the present invention and the advantages thereof, the following specific Example is given, it being understood that this Example is intended only to be an illustration without serving as a limitation on the scope of the present invention.

EXAMPLE

An example of an ultrasonic pump of the present invention as depicted in FIGS. 1–5(*a*)–5(*c*) and described in the detailed specification, will be illustrated. It should be apparent to those of skill in this art that the shapes, dimensions and materials utilized for this ultrasonic pump can be varied so long as the objectives of the present invention are not defeated.

A pump body 30 is acetal plastic, approx. 3.15" high× 4.00" diameter. It has a conical inner surface or tapered chamber 12 designed to accept the non-planar, spherically-shaped, transducer described hereafter at the first or largeer diameter-end 60 of the cone 12. The length of tapered chamber 12 is about 2.915". Supporting pump body 30 are four acetal plastic legs 90.

At the exit port 3 of housing 30, a recess (not shown) accepts aluminum tapered nozzles, each having a first orifice for medium entry having a diameter of about 1.0" and a second or exit orifice for allowing medium to exit the nozzles 14,15 and 16, respectively, with an inside diameter of, for example, 0.25", 0.375" or 0.50". The medium enters the housing or body 30 through inlet 2 and a hose barb fitting from the side near the spherically-shaped transducer face. A removable top plate 32 held on by screw bolts 50 retains the nozzle and accepts a hose barb fitting and a removable bottom plate 31 is also held on by screw bolts 50. All pipe threads are ¼" NPT, and tubing is ⅜" ID×½" OD.

The ultrasonic pump functions by the absorption of ultrasonic energy by the medium. In other words, momentum in the ultrasonic waves is transferred to the medium as the waves, which are produced directly into the medium by the non-planar, transducer assembly, are absorbed by the medium to pump the medium. This phenomenon is known as acoustic streaming.

The specifications of an exemplary non-planar, spherically-shaped, transducer in accordance with the present invention are as follows:

| | |
|---|---|
| Center Frequency: | 1.1 MHZ (fundamental mode)<br>3.35 MHZ (third harmonic) |
| Bandwidth: | 0.85 to 1.35 MHZ (±250 KHz around the fundamental)<br>3.08 to 3.75 MHZ (±220 KHz around the third harmonic) |
| Active diameter: | 69.94 mm (2.753 inches) |
| Geometric Focus: | 62.64 mm (2.466 inches) = radius of curvature of front radiating surface) |
| Focal depth: | 51.74 mm (2.037 inches); measured from exit plane of transducer housing nm to geometric focus |
| No. of elements: | One |
| Impedance: | See FIGS. 8–9. |
| Environment: | Immersible in water to a depth of 0.5 meters, 0 to 60° C. |
| Cable: | RG-58 50 Ohm coax, exits housing on side |
| Connector: | BNC male on transducer cable; BNC females on both ends of matching network |

-continued

| | |
|---|---|
| Transducer housing: | Nickel-plated brass, 3.220 inches diameter × 0.750 inches high |
| Mounting holes: | Six tapped holes on rear of housing, 6 – 32 × 0.4 inch deep for mounting to tanks or fixtures |
| RF shielding: | Transducer housing is RF shielded. Conductive transducer face and RF shield are connected to cable ground return. The matching network is housed in a separate shielded enclosure. |

RF impedance matching networks are supplied with the transducer, intended for use with a 50 Ohm RF amplifier with a maximum average power level of about 400 W. One network is to be used for operation in the vicinity of the fundamental mode at about 1.1 MHZ, while a second network is to be used in the vicinity of the third harmonic at about 3.35 MHZ.

An Hewlett-Packard Model No. HP 4194A Impedance/Gain-Phase Analyzer is used to measure the electrical input impedance of the transducer. During these measurements, the transducer face was in room-temperature water with no reflectors. In the attached plots, the transducer impedance is shown at the fundamental with and without the RF matching network, and with water loading on the radiating surface.

The plots show the impedance magnitude and its phase. In all cases, the phase is plotted from −90 to +90 degrees. The magnitude scale is adjusted as required to display the plot data. The measurements are from about 100 HZ to about 2.2 MHZ (upper), and from about 2.2 to about 4.4 MHZ (lower).

With the matching network, the impedance is 44 Ohms/−-31° at the fundamental. Note the impedance curve shape in the vicinity of 1.1 MHZ. The transducer can be used from approximately 0.75 MHZ to about 1.45 MHZ, corresponding to the region where the impedance has a significant real part. At third harmonic, the Impedance is 59 Ohms/+27°.

The matching network will only function correctly if it is connected directly to the transducer, with no added cable length. The cable length between the RF amplifier and the transducer should not have a significant effect on performance. Due to high power levels, the current in the cable is fairly high (about 5 Amps rms at 100 W and 1.1 MHZ; about 15 amps at 3.3 MHZ).

For operation at sustained power levels, the matching network fan should be used. Power is supplied to the fan via a connector on the matching network housing (+12 VDC to the center contact).

The physical dimensions can be changed along with the ultrasonic frequencies. Higher power up to about 400 W or more is believed to be possible. Continuous or pulsed operation may be employed.

It is believed that changes in the outlet region diameter of the tapered-nozzles will have an effect, and that the smaller orifices will work better so long as they are strategically positioned at about the focal zone of the longitudinal waves generated by the transducer.

Preferably and acoustically, the conically-shaped or tapered chamber size, including the nozzle region, should ideally correspond to the beam pattern of the longitudinal waves and extend a distance equal to about the length of the focal region generated by the transducer, i.e., the length of the longitudinal waves between the transducer assembly 6 and the focal spot of the longitudinal wave, i.e., focal zone.

In the ultrasonic pump described in this Example and in FIGS. 1–5*a*–5*c*, the focal region is about 0.180" in diameter (including the first side lobes) at about 1.1 MHZ, and about 0.060" in diameter at about 3.3 MHZ. Transducer placement in the ultrasonic pumps of the present invention and this Example is believed to be determined by the focal characteristics and the location of the outlet orifice. It is further believed that, under conditions that produce cavitation, the ultrasonic pumps of the present invention and this Example, greater flow and head will result. In other words, it is believed that pump output for ultrasonic pumps of the present invention and this Example is greater under cavitation conditions.

Referring now to pump graphs depicted in FIGS. 6–7, flow rates and pump heads at different watts are illustrated.

FIG. 6 depicts a measured pump graph using a frequency of about 1.1 MHZ. The flow rate is shown in milliliters/minute on the X axis, and the pump head in cm of water is shown on the Y axis. The three curves correspond to different RF input power levels to a spherical transducer as described in this Example; the first curve from left on graph is at 60 Watts, the second curve from left represents 110 Watts, the third curve from left represents 180 Watts, the fourth curve from left represents 240 Watts, and the fifth curve from left represents 290 Watts. In all tests, the smallest orifice diameter of the tapered-nozzle is about 0.25", as depicted at 14 in FIGS. 5*a*–5*c*.

FIG. 7 depicts a measured pump graph using a frequency of about 3.3 MHz. The flow rate is shown in millimeters/minute on the X axis, and the pump head in cm of water is shown on the Y axis. The three curves correspond to different RF input power levels to a spherical transducer as described in the Example; the first curve from left on graph is at 60 Watts, the second curve from left represents 110 Watts, the third curve from left represents 180 Watts, the fourth curve from left represents 240 Watts, and the fifth curve from left represents 290 Watts. In all tests, the smallest orifice diameter of the tapered-nozzle is about 0.25", as depicted at 14 in FIGS. 5*a*–5*c*.

It is believed that better flow rates and pump head are obtained with an ultrasonic pump of this Example and as shown in FIGS. 1–5*a*–5*c* at a frequency of about 1.1 MHZ with 300 watts of power; the flow rate is approximately 2800 ml/minute and the pump head is approximately 84 cm.

Accordingly, it will be understood that embodiments of the present invention have been disclosed by way of example and that other modifications and alterations may occur to those skilled in the art without departing from the scope and spirit of the appended claims. Moreover, even though preferred embodiments of the present invention have been illustrated in the accompanying Figs. and described in the foregoing Example, it will be understood that the invention is not limited to the preferred embodiments disclosed, but is capable of numerous rearrangements, modifications and substitutions without departing from the spirit of the invention as set forth and defined by the following claims. Thus, the invention described herein extends to all such modifications and variations as will be apparent to the reader skilled in the art, and also extends to combinations and sub-combinations of the features of this description and the accompanying Figs.

Having described my invention, I claim:

1. An ultrasonic pump comprising:

a housing having a chamber, said chamber having at one end a first opening and at the opposite end a second opening, said housing further having an inlet for medium entry into said chamber and an outlet in communication with the second opening for allowing medium to exit said chamber and said pump;

a non-planar, transducer for cooperating with the first opening of said chamber and for generating ultrasonic, focused, longitudinal waves having a focused beam pattern and a focal zone, said chamber having a shape which substantially corresponds to the focused beam pattern; and a tapered-nozzle separate from said chamber having a first orifice and an exit orifice and a pathway between said first and exit orifices for directing the medium and longitudinal waves generated by said transducer flowing through said chamber into the first orifice and from the exit orifice through the outlet of said housing, the first orifice of said nozzle and the second opening of said chamber each having a diameter size which substantially corresponds to one another, the exit orifice having a diameter size which is less than the diameter size of the first orifice and the second opening having a diameter size which is less than the diameter size of the first opening in said chamber, the exit orifice of said tapered nozzle being located at approximately the focal zone of the focused pattern for the ultrasonic, focused, longitudinal waves.

2. An ultrasonic pump of claim 1, said transducer and the first opening each having a shape and diameter size which corresponds to one another.

3. An ultrasonic pump of claim 1, wherein said chamber has a shape which corresponds to the focused pattern for the ultrasonic, focused, longitudinal waves generated by said transducer.

4. An ultrasonic pump of claim 3, wherein said chamber is tapered in shape.

5. An ultrasonic pump of claim 3, wherein the pathway of said nozzle is tapered.

6. An ultrasonic pump of claim 1, wherein said nozzle is formed of a material which has a melting point that is higher than the boiling point of the medium.

7. An ultrasonic pump of claim 1, wherein said exit orifice is no greater than about 0.5".

8. An ultrasonic pump of claim 1, wherein said exit orifice is a size of about 0.5".

9. An ultrasonic pump of claim 1, wherein said exit orifice is a size of about 0.375".

10. An ultrasonic pump of claim 1, wherein said exit orifice is a size of no greater than about 0.25".

11. An ultrasonic pump of claim 1, wherein said tapered transducer has a diameter of about 4" or less.

12. An ultrasonic pump of claim 1, wherein said transducer has a diameter of about 3".

13. An ultrasonic pump of claim 1, wherein said pump does not utilize a lens to focus the longitudinal waves.

14. An ultrasonic method of pumping a medium comprising:

introducing focused longitudinal traveling waves having a focused beam pattern and a focal zone into a chamber, wherein the focused longitudinal traveling waves are produced by a non-planar transducer in communication with the chamber, the chamber having a shape which substantially corresponds to the focused beam pattern, introducing said longitudinal traveling waves through a tapered nozzle member separate from said chamber disposed at about the focal zone to permit a medium being pumped through the chamber to exit the chamber, said nozzle member having a first orifice, a second orifice, and a fluid pathway extending between said first orifice and said second orifice, said second orifice of said tapered nozzle member having an internal diameter less than an internal diameter of said first orifice, introducing a medium to be pumped into the chamber through which the focused longitudinal traveling waves are traveling to impart momentum to the medium, and pumping the medium.

15. An ultrasonic method of claim 14, wherein said method does not utilize a lens to focus the longitudinal waves.

16. An ultrasonic method of claim 14, wherein the chamber is positioned within a housing having an outlet in communication with the nozzle member, said method including the further step of pumping the medium through the outlet to exit the housing.

17. An ultrasonic method of claim 16, said method including the further step of absorbing the focused longitudinal traveling waves that have passed through the nozzle member.

18. An ultrasonic method of claim 16, said method including the further step of absorbing the focused longitudinal traveling waves that have passed through the outlet.

19. An ultrasonic method of claim 14, said method including the further step of focusing the focal zone of the focused longitudinal traveling waves at about an exit orifice of the nozzle member.

20. An ultrasonic method of claim 14, said method including the further step of reflectively focusing the focal zone of the focused longitudinal traveling waves at about an exit orifice of the nozzle member.

21. An ultrasonic pump comprising:

a housing having a chamber for receiving a fluid, said chamber having a fluid inlet and a fluid outlet;

a non-planar tranducer operable to generate ultrasonic, focused, longitudinal waves having a beam pattern and defining a focal zone; and a tapered-nozzle separate from said chamber disposed in said fluid outlet of said chamber, said nozzle having a first orifice, a second orifice, and a fluid pathway extending between said first orifice and said second orifice, said nozzle focusing a radiation energy density to impart momentum to said fluid, said first orifice of said nozzle having an internal diameter generally equal to an internal diameter of said fluid outlet, said second orifice of said nozzle having an internal diameter less than said internal diameter of said first orifice, said second orifice of said nozzle being disposed at approximately said focal zone.

22. The ultrasonic pump according to claim 21, wherein said chamber has a shape generally closely conforming to said beam pattern.

23. The ultrasonic pump according to claim 21, wherein said chamber is tapered in shape.

24. The ultrasonic pump according to claim 21, wherein said fluid pathway of said nozzle is tapered.

25. The ultrasonic pump according to claim 21, wherein said nozzle is formed of a material which has a melting point that is higher than the boiling point of the medium.

26. The ultrasonic pump according to claim 21, wherein said second orifice is no greater than about 0.5" in diameter.

27. The ultrasonic pump according to claim 21, wherein said second orifice is a size of about 0.5" in diameter.

28. The ultrasonic pump according to claim 21, wherein said second orifice is a size of about 0.375" in diameter.

29. The ultrasonic pump according to claim 21, wherein said second orifice is a size of no greater than about 0.25".

30. The ultrasonic pump according to claim 21, wherein said tapered transducer has a diameter of about 4" or less.

31. The ultrasonic pump according to claim 21, wherein said transducer has a diameter of about 3".

32. The ultrasonic pump according to claim 21, wherein the ultrasonic pump does not utilize a lens to focus said longitudinal waves.

33. A method of pumping a medium using an ultrasonic pump, said ultrasonic pump having a chamber and a non-planar tranducer, said ultrasonic pump having a fluid inlet and a fluid outlet, a tapered-nozzle separate from said chamber disposed between said chamber and said fluid outlet, said method comprising:

introducing the medium into said chamber through said fluid inlet;

outputting longitudinal traveling waves from said transducer into said chamber, said longitudinal traveling waves defining a beam pattern and a focal zone; and passing said longitudinal traveling waves through an entry orifice of said nozzle to an exit orifice of said nozzle, said exit orifice of said nozzle having an internal diameter less than an internal diameter of said entry orifice, said nozzle being located at about said focal zone, said passing of said longitudinal traveling waves through said nozzle imparting momentum to the medium, thereby pumping the medium.

34. The method according to claim 33, wherein said method does not utilize a lens to focus the longitudinal waves.

35. The method according to claim 33, said method including the further step of absorbing the longitudinal traveling waves that have passed through the nozzle.

36. The method according to claim 33, said method including the further step of absorbing the longitudinal traveling waves that have passed through the outlet.

37. The method according to claim 33, said method including the further step of focusing the focal zone of the longitudinal traveling waves at about the exit orifice of the nozzle.

38. The method according to claim 33, said method including the further step of reflectively focusing the focal zone of the longitudinal traveling waves at about the exit orifice of the nozzle.

* * * * *